US012516484B1

(12) United States Patent
Fuller

(10) Patent No.: US 12,516,484 B1
(45) Date of Patent: Jan. 6, 2026

(54) METHODS AND STRUCTURES FOR INSTALLING PILES

(71) Applicant: Andrew C. Fuller, Ridgeville, SC (US)

(72) Inventor: Andrew C. Fuller, Ridgeville, SC (US)

( * ) Notice: Subject to any disclaimer, the term of this patent is extended or adjusted under 35 U.S.C. 154(b) by 0 days.

(21) Appl. No.: 18/106,618

(22) Filed: Feb. 7, 2023

(51) Int. Cl.
*E02D 7/22* (2006.01)
*E02D 5/36* (2006.01)
*E02D 5/56* (2006.01)

(52) U.S. Cl.
CPC *E02D 5/36* (2013.01); *E02D 5/56* (2013.01)

(58) Field of Classification Search
CPC .... E02D 5/36; E02D 5/56; E02D 7/22; E02D 5/223; E02D 5/46; E02D 5/801
See application file for complete search history.

(56) References Cited

U.S. PATENT DOCUMENTS

| | | | | |
|---|---|---|---|---|
| 2,146,645 A | | 2/1939 | Newman | |
| 2,983,345 A | | 5/1961 | Langer | |
| 3,540,225 A | | 11/1970 | Muller | |
| 3,645,055 A | | 2/1972 | Roza | |
| 3,680,274 A | | 8/1972 | Deike | |
| 4,650,372 A | | 3/1987 | Gorrell | |
| 5,066,168 A | | 11/1991 | Holdeman | |
| 5,575,122 A | | 11/1996 | Hamilton | |
| 5,707,180 A | * | 1/1998 | Vickars | E21B 10/44 405/249 |
| 5,904,447 A | | 5/1999 | Sutton et al. | |

(Continued)

FOREIGN PATENT DOCUMENTS

| | | |
|---|---|---|
| GB | 2418949 A | 4/2006 |
| JP | 1-244015 A | 9/1989 |

(Continued)

OTHER PUBLICATIONS

Timothy W. Mays, Ph.D., P.E. and Ryan Keiper, P.E.; Grout Volume During Placement, Fuller PileTM Technical Note 1-22 (2022) (2 pages).

(Continued)

*Primary Examiner* — Amber R Anderson
*Assistant Examiner* — Stacy N Lawson
(74) *Attorney, Agent, or Firm* — Jeremy M. Stipkala; Thrive IP®

(57) ABSTRACT

Methods of installing a pile in soil include optionally pre-drilling an upper hole in the soil and adding liquid grout thereto; driving a helical pile lead section into the soil, coaxially with the upper hole if present, thereby creating a deep hole about the helical pile lead section; adding liquid grout to the deep hole as it is created; optionally adding one or more additional sections to the helical pile lead section before and/or during the driving of the helical pile lead section into the soil; wherein the pile comprises the helical pile lead section and the one or more additional sections if present; wherein the pile has a lower end defined by a deepest part of the helical pile lead section, and an upper end opposite the lower end; adding a reinforcing structure proximal to the upper end of the pile; and allowing the liquid grout to harden about the pile and the reinforcing structure. Piles and pile assemblies installed according to those methods also appear. A pile assembly includes an installed pile, a reinforcing structure, and hardened grout about the pile and the reinforcing structure.

16 Claims, 9 Drawing Sheets

(56) References Cited

U.S. PATENT DOCUMENTS

| | | | | |
|---|---|---|---|---|
| 6,058,662 | A | 5/2000 | Perko | |
| 6,264,402 | B1 * | 7/2001 | Vickars | E02D 5/46 405/251 |
| 6,368,021 | B1 | 4/2002 | Strong et al. | |
| 6,652,195 | B2 | 11/2003 | Vickars et al. | |
| 6,722,821 | B1 * | 4/2004 | Perko | E02D 5/801 405/249 |
| 6,814,525 | B1 | 11/2004 | Whitsett | |
| 7,037,045 | B2 | 5/2006 | Jones | |
| 7,314,335 | B2 | 1/2008 | Whitsett | |
| 7,416,367 | B2 | 8/2008 | St. Onge | |
| 7,494,299 | B1 | 2/2009 | Whitsett | |
| 7,546,887 | B2 | 6/2009 | Schwab | |
| 7,854,451 | B2 | 12/2010 | Davis, II | |
| 8,033,757 | B2 | 10/2011 | Stroyer | |
| 8,240,957 | B1 | 8/2012 | Watson, III | |
| 8,506,207 | B2 | 8/2013 | Lutenegger et al. | |
| 8,613,571 | B1 | 12/2013 | Watson, III | |
| 8,631,627 | B2 | 1/2014 | Atchley | |
| 8,926,228 | B2 | 1/2015 | Stroyer | |
| 9,051,706 | B1 * | 6/2015 | Ludwig | E02D 7/22 |
| 9,181,674 | B2 | 11/2015 | El Naggar | |
| 9,631,335 | B2 | 4/2017 | Reusing et al. | |
| 9,689,134 | B1 | 6/2017 | Li | |
| 10,024,020 | B2 | 7/2018 | Fuller | |
| 10,392,768 | B2 | 8/2019 | Kemp | |
| 11,851,839 | B1 | 12/2023 | Fuller | |
| 2002/0150430 | A1 | 10/2002 | Vickars et al. | |
| 2003/0159839 | A1 | 8/2003 | Perko | |
| 2006/0051183 | A1 | 3/2006 | Powell | |
| 2007/0286686 | A1 * | 12/2007 | Lindsey | E02D 5/801 405/233 |
| 2012/0037261 | A1 | 2/2012 | Nagata | |
| 2012/0114425 | A1 | 5/2012 | Seider et al. | |
| 2015/0117960 | A1 | 4/2015 | Kemp et al. | |
| 2015/0233075 | A1 | 8/2015 | Maggio | |
| 2015/0345098 | A1 | 12/2015 | Song | |
| 2016/0251819 | A1 | 9/2016 | Dinh | |
| 2017/0198453 | A1 | 7/2017 | Brown | |
| 2018/0030681 | A1 | 2/2018 | Stroyer | |
| 2018/0155893 | A1 | 6/2018 | Fuller | |
| 2018/0258602 | A1 | 9/2018 | Kemp | |
| 2019/0127940 | A1 | 5/2019 | Kaufman | |
| 2019/0271131 | A1 * | 9/2019 | Perko | E02D 5/56 |
| 2019/0324007 | A1 | 10/2019 | Dugard | |
| 2022/0136200 | A1 | 5/2022 | Kitamura | |

FOREIGN PATENT DOCUMENTS

| | | | | |
|---|---|---|---|---|
| KR | 101155156 | B1 * | 6/2012 | E04H 12/2223 |
| KR | 20150001174 | A * | 1/2015 | E02D 7/20 |
| WO | 2014192677 | A1 | 12/2014 | |

OTHER PUBLICATIONS

Timothy W. Mays, Ph.D., P.E.; Fuller Pile Head Connection Detailing, Fuller PileTM Technical Note 2-22 (2022) (2 pages).
Timothy W. Mays, Ph.D., P.E.; Fuller Pile Specialty and Residential Head Details, Fuller PileTM Technical Note 3-22 (2022) (2 pages).
Timothy W. Mays, Ph.D., P.E. and Ryan Keiper, P.E.; Elevated Design Using Continuous Fuller Pile-Column Elements Without The Need For Grade Beams Or Lateral Support Elements At Grade; Fuller PileTM Technical Note 7-23 (2023) (2 pages).
Unpublished U.S. Appl. No. 18/479,448, filed Oct. 2, 2023 (38 pages).
Machine translation of Japanese Patent Application No. 1-244015 (18 pages).
Machine Translation of WO 2014/192677 A1 (25 pages).
International Search Report for PCT/US2024/049381 dated Dec. 13, 2024 (3 pages).
Written Opinion for PCT/US2024/049381 dated Dec. 13, 2024 (7 pages).
Non-Final Office Action dated May 5, 2025, in U.S. Appl. No. 18/479,488 (8 pages).
Final Office Action dated Nov. 14, 2025, in U.S. Appl. No. 18/479,448 (7 pages).

* cited by examiner

© 2023 Andrew C. Fuller

© 2023 Andrew C. Fuller

© 2023 Andrew C. Fuller

© 2023 Andrew C. Fuller

© 2023 Andrew C. Fuller

© 2023 Andrew C. Fuller

© 2023 Andrew C. Fuller

© 2023 Andrew C. Fuller

© 2023 Andrew C. Fuller

METHODS AND STRUCTURES FOR INSTALLING PILES

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to installation of piles for construction of roads, buildings, and other structures.

BACKGROUND OF THE INVENTION

Construction piles stabilize soil and support buildings, roads, bridges, and other man-made structures. It is important to design, build, and install those piles in ways that ensure adequate support that will endure at least as long as the service life of the supported structures. That is true because accessing and repairing the piles after construction is, in many cases, practically impossible short of demolishing the supported structure. Unfortunately, it is possible to install a pile inadequately, so the installed pile does not meet the performance expectations of the designing engineer. Accordingly, such piles may be over-engineered to account for foreseeable variations in installation. Improvements in construction pile technology are needed.

Conventionally, performance requirements in terms of the lateral forces handled by an installed pile are applied to the entire length of the pile. That is true whether the pile is a few feet long or 100 feet. However, Applicant has observed that a majority of the lateral forces act on the uppermost regions of an installed pile, in some cases on the uppermost 10% of the length of that pile. Unexpectedly, Applicant has found that engineering solutions to improve pile performance need not apply to the entire length of the pile. Or, to put it another way, adding reinforcing structure to the top 10 feet or so of a pile can dramatically improve performance.

SUMMARY OF THE INVENTION

Accordingly, Applicant has unexpectedly invented new methods for installing a pile in soil, one such method comprising: optionally pre-drilling an upper hole in the soil and adding liquid grout thereto;

- driving a helical pile lead section into the soil, coaxially with the upper hole if present, thereby creating a deep hole about the helical pile lead section;
- adding liquid grout to the deep hole as it is created;
- optionally adding one or more additional sections to the helical pile lead section before and/or during the driving of the helical pile lead section into the soil;
- wherein the pile comprises the helical pile lead section and the one or more additional sections if present;
- wherein the pile has a lower end defined by a deepest part of the helical pile lead section, and an upper end opposite the lower end;
- adding a reinforcing structure proximal to the upper end of the pile; and
- allowing the liquid grout to harden about the pile and the reinforcing structure.

Further embodiments of the present invention relate to a pile installed in soil according to any one or more of the methods disclosed herein.

Additional embodiments relate to pile assemblies. In general, a pile assembly represents an installed pile with its attendant grout and reinforcing structure that may connect the pile to a pile cap or other material supported by the pile. In some cases, a pile assembly includes a pile having an upper end opposite a lower end, the pile being in soil; a reinforcing structure proximal to the upper end; and hardened grout about the pile and the reinforcing structure. For example, the reinforcing structure can be a rebar cage. For another example, a pile assembly includes a pile and an outer pipe coaxial with the pile. The outer pipe, wider in diameter than the pile, can be connected to the pile, such as by welding or bolts. Or the outer pipe can be free-standing, simply held in place by hardened grout between the outer pipe and the pile, the grout having been poured during installation of the pile in soil, for example.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
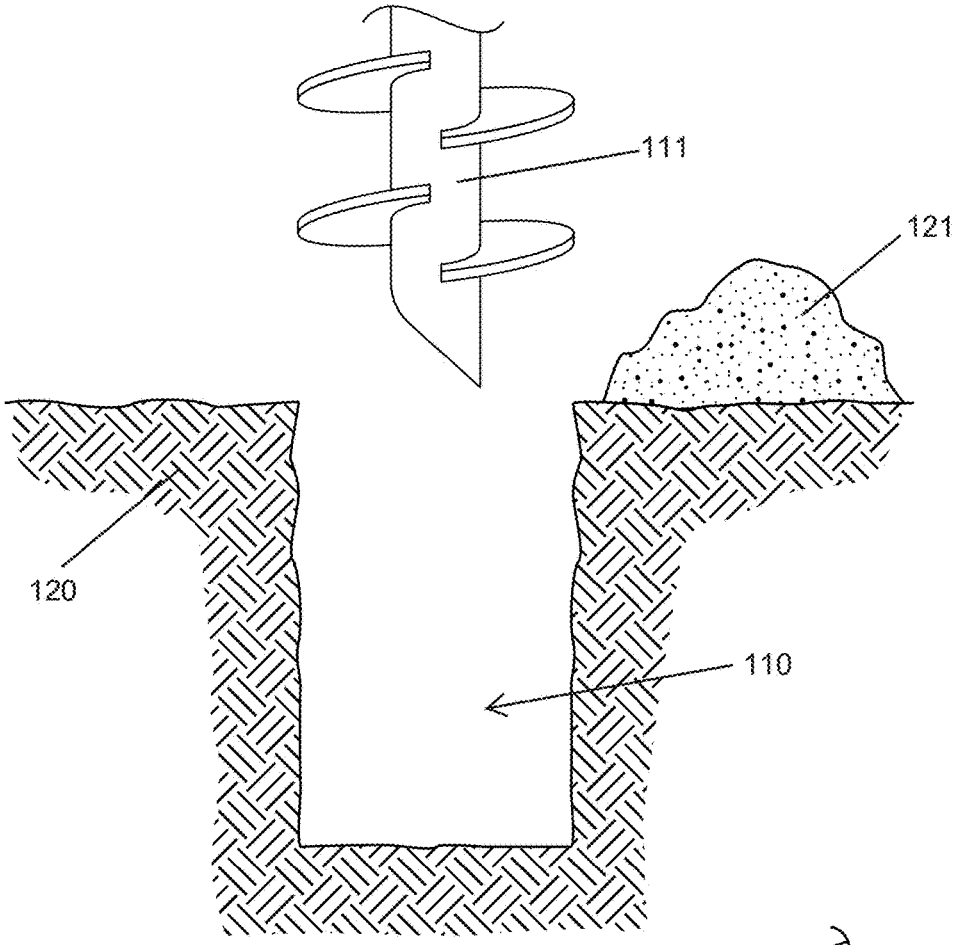
FIG. 1 depicts a cut-away side view of upper hole 110 being drilled in soil 120.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated above, certain embodiments of the present invention related to methods of installing a pile in soil. One such method includes optionally pre-drilling an upper hole in the soil and adding liquid grout thereto;

driving a helical pile lead section into the soil, coaxially with the upper hole if present, thereby creating a deep hole about the helical pile lead section;

adding liquid grout to the deep hole as it is created;

optionally adding one or more additional sections to the helical pile lead section before and/or during the driving of the helical pile lead section into the soil;

wherein the pile comprises the helical pile lead section and the one or more additional sections if present;

wherein the pile has a lower end defined by a deepest part of the helical pile lead section, and an upper end opposite the lower end;

adding a reinforcing structure proximal to the upper end of the pile; and allowing the liquid grout to harden about the pile and the reinforcing structure.

Liquid grout can be added in any suitable manner. For example, liquid grout can be added by gravity, adding grout under pressure, or a combination thereof. The grout can be added from above, or through the pile itself, or even from below with a suitable apparatus inserted into the hole. It may be that the pile is at least partially hollow, allowing the liquid grout to flow into the hole through the pile. Suitable apertures along the length of the pile or near the lower end can allow liquid grout to flow out of the hollow pile into the hole in some instances. Adding liquid grout to the upper hole can happen before, during, after, or a combination thereof, of placing the helical pile lead section into the upper hole. Pressure can drive liquid grout according to any suitable method. For example, an impellor can be brought to bear to augment the force of gravity to inject liquid grout into the deep hole.

The upper hole where present can have any suitable dimensions. It should be wide enough to accommodate the pile and the reinforcing structure along with the grout that will support those materials. In some cases, the upper hole has an upper hole diameter of at least about 6 inches, at least about 8 inches, at least about 10 inches, at least about 12 inches, at least about 14 inches, at least about 16 inches, at least about 20 inches, at least about 22 inches, at least about 24 inches, at least about 30 inches, at least about 36 inches, or at least about 48 inches. In other cases, the upper hole has an upper hole diameter that is no more than about 6 inches, no more than about 8 inches, no more than about 10 inches, no more than about 12 inches, no more than about 14 inches, no more than about 16 inches, no more than about 20 inches, no more than about 22 inches, no more than about 24 inches, no more than about 30 inches, no more than about 36 inches, or no more than about 48 inches.

The depth of the upper hole likewise can have any suitable dimension. It should be deep enough to receive the reinforcing structure. The upper hole is wider than and not as deep as the deep hole described herein. In certain instances, the entirety of the reinforcing structure fits within the dimensions of the upper hole. For example, all parts of the reinforcing structure could have at least 3" of grout shielding it from the sides and bottom of the upper hole in some cases. In other instances, the reinforcing structure contacts or even penetrates the soil below or beside the upper hole, and/or extends into the deep hole. In still other instances, the reinforcing structure extends above the surface of the soil. In this way, a portion of the reinforcing structure engages and connects the supported structure above the soil, and assists with distributing the axial and lateral forces the pile assembly is designed to handle. Accordingly, in some cases, the upper hole has an upper hole depth measured from the surface of the soil of at least about 2 feet deep, at least about 3 feet deep, at least about 4 feet deep, at least about 5 feet deep, at least about 6 feet deep, at least about 7 feet deep, at least about 8 feet deep, at least about 9 feet deep, at least about 10 feet deep, at least about 11 feet deep, at least about 12 feet deep, at least about 13 feet deep, at least about 14 feet deep, at least about 15 feet deep, at least about 16 feet deep, at least about 17 feet deep, at least about 18 feet deep, at least about 19 feet deep, at least about 20 feet deep, at least about 25 feet deep, or at least about 30 feet deep. In other cases, the upper hole has an upper hole depth measured from the surface of the soil of no more than about 2 feet deep, no more than about 3 feet deep, no more than about 4 feet deep, no more than about 5 feet deep, no more than about 6 feet deep, no more than about 7 feet deep, no more than about 8 feet deep, no more than about 9 feet deep, no more than about 10 feet deep, no more than about 11 feet deep, no more than about 12 feet deep, no more than about 13 feet deep, no more than about 14 feet deep, no more than about 15 feet deep, no more than about 16 feet deep, no more than about 17 feet deep, no more than about 18 feet deep, no more than about 19 feet deep, no more than about 20 feet deep, no more than about 25 feet deep, or no more than about 30 feet deep.

Any suitable pile can be used. As used herein, the upper end and the lower end of the pile refer to the orientation the pile will assume when finally installed in the soil. A helical pile lead section indicates, in some cases, a pipe with any suitable screw mechanism attached to the pipe so that turning the pipe causes the screw mechanism to engage the soil and draw the pipe into the soil. As the lead section pulls itself into the soil, the surrounding soil is displaced by compression, forming a deep hole around the pile. The lower end can be simply an open pipe, or it may terminate in a point or other suitable geometry. Optionally, a pile can employ the bit of U.S. Pat. No. 10,024,020 B2, to create an even wider portion of the deep hole about the pile. That wider portion can be grooved, as described in that patent. Driving the helical pile lead section into the soil can happen according to any suitable method. For example, a properly-equipped excavator or similar piece of heavy equipment can turn the helical pile lead section, causing the lead section to be drawn deeper into the soil.

A pile can be formed by a single helical pile lead section, or it can have one or more additional sections added to the lead section before and/or during installation. The additional sections can have any suitable length, such as two feet long or shorter in some examples. In other examples, piles can be 10 feet long, 12 feet long, 20 feet long, or longer, as desired. The additional sections can be the same or different lengths in the same pile. Additional sections can have the same or different diameter as each other and as the lead section, as desired. In further instances of the present invention, the lead section and the additional sections all have the same nominal pipe diameter for ease of manufacture and installation. Additional sections can be joined to the helical pile lead section and to each other with any suitable structure or method. In certain instances, additional sections are added with at least one bolted splice. A bolted splice may represent a sleeve that is of a wider inner diameter so as to receive the ends of two adjacent sections of the pile, and to bolt or otherwise attach them together. Or, one end of an additional section can terminate in a wider portion that fits over the outer diameter of an adjacent section. Appropriately placed bolt holes thereby allow the joining of the two sections. The bolted splice should be strong enough to allow the driving of the pile as an upper section is rotated to turn the lead section drawing the pile into the soil. Optionally, one or more of the additional sections have their own screw mechanisms to engage the soil and assist with drawing the pile into the soil as it is rotated. Further optional structures include so-called Nelson studs along the surface of part or all of the pile. Nelson studs, as used herein, include any structure that protrudes from the vertical surface of a pile to engage hardened grout. In one example, a Nelson stud is a bolt, screw, or piece of rebar one to six inches from the surface of the pile.

The so-called deep hole can have any suitable dimensions. It should be wide enough to receive the pile and liquid grout. In addition, where no upper hole has been drilled, the deep hole should be wide enough to accommodate the reinforcing structure, optionally with even more room for grout outside the reinforcing structure. In certain instances, the deep hole measured from the surface of the soil is at least about 5 feet deep, at least about 10 feet deep, at least about 15 feet deep, at least about 20 feet deep, at least about 25 feet deep, at least about 30 feet deep, at least about 40 feet deep, at least about 50 feet deep, at least about 75 feet deep, at least about 100 feet deep, at least about 125 feet deep, or at least about 150 feet deep. In other instances, the deep hole measured from the surface of the soil is no more than about 5 feet deep, no more than about 10 feet deep, no more than about 15 feet deep, no more than about 20 feet deep, no more than about 25 feet deep, no more than about 30 feet deep, no more than about 40 feet deep, no more than about 50 feet deep, no more than about 75 feet deep, no more than about 100 feet deep, no more than about 125 feet deep, or no more than about 150 feet deep.

An installed pile is an engineered solution to stabilize soil and to support a structure thereon. Accordingly, it is often useful to drive the helical pile lead section into the soil so that the upper end of the pile achieves a pre-calculated final position relative to the surface of the soil. In some examples, the final position is at or below the surface of the soil. This can be useful, for example, when the reinforcing structure is provided to function as the primary conduit for distributing forces from the supported structure above. In other examples, the pile achieves a depth in the soil such that the final position of the upper end of the pile is above the surface of the soil. In some cases, the final position is at least about 2 inches, at least about 3 inches, at least about 4 inches, at least about 6 inches, at least about 8 inches, at least about 10 inches, at least about 12 inches, at least about 14 inches, at least about 18 inches, at least about 24 inches, at least about 36 inches, or at least about 48 inches, above the surface of the soil. In other cases, the final position is no more than about 2 inches, no more than about 3 inches, no more than about 4 inches, no more than about 6 inches, no more than about 8 inches, no more than about 10 inches, no more than about 12 inches, no more than about 14 inches, no more than about 18 inches, no more than about 24 inches, no more than about 36 inches, or no more than about 48 inches, above the surface of the soil.

The reinforcing structure can be presented in any suitable manner. In some cases, the reinforcing structure is placed in the upper hole if present, or in the deep hole about the upper end of the pile, and held in place by some suitable means until the liquid grout hardens to hold the reinforcing structure in place. For example, a rebar cage can be tied to the pile or another guiding structure with string, rope, or wire. Guiding structure may include, for example, wooden framing, or one can employ a rebar grid as guiding structure that will be used to form a pile cap that partially embeds the pile and/or reinforcing structure. In other cases, the reinforcing structure is attached to the uppermost additional section of the pile. The reinforcing structure can be affixed proximal to the upper end by any suitable means. For instance, affixing can involve bolting, welding, or a combination thereof. Affixing may also include drilling or forming holes in an additional section, and inserting one or more rebar members into those holes, optionally bending the inserted rebar members as desired to form a rebar cage, optionally connected to additional rebar members. The reinforcing structure can be added to the liquid grout once the pile is in place, for example. Or the reinforcing structure, affixed to the uppermost section of the pile, can be installed with that uppermost section.

Any suitable reinforcing structure can be used, alone or in combination. In some embodiments, the reinforcing structure includes a rebar cage. The rebar cage requires no particular structure. Often, though, it may be useful to have horizontal members and vertical members form the rebar cage to strengthen the grout about the upper end of the pile. The vertical members, at least, can extend above the grout and above the soil in certain instances to engage the supported structure above the pile. Some cases allow a rebar cage to be constructed of straight vertical pieces of rebar tied to horizontal pieces of rebar. Those horizontal pieces can be straight, circular, spiral, another shape, or no defined shape at all. A circular piece can be made by bending straight rebar with a pipe bender or other suitable instrument. The circular pieces can have any desired diameter, for example, greater than the diameter of the pile and less than the diameter of the upper hole. The various members of the rebar cage can be spaced apart any suitable distance, such as, for example, at least two inches to no more than about 12 inches. In other embodiments, the reinforcing structure comprises an outer pipe. In still other embodiments, the reinforcing structure includes a rebar cage and an outer pipe.

Liquid grout can be added to the hole in any suitable amount. Additional instances provide an amount of liquid grout that is at least about 70%, at least about 80%, at least about 90%, at least about 100%, at least about 110%, at least about 120%, at least about 130%, at least about 140%, or at least about 150% of the volume of a cylinder having the depth and the diameter of the deep hole. If present, the volume of a cylinder having the volume of the upper hole (not including the volume of the deep hole inside the upper hole) is also taken into account. The volume (V) of a cylinder is given by the following formula (I):

$$V=\pi\times(\text{Diameter}/2)^2\times\text{Depth} \quad \text{(I)}$$

In certain instances, the liquid grout is added to the deep hole and the upper hole if present in an amount, the amount being at least about 70%, at least about 80%, at least about 90%, at least about 100%, at least about 110%, at least about 120%, at least about 130%, at least about 140%, or at least about 150% of the volume of the deep hole plus the volume of the upper hole if present. Obviously, the volume of the deep hole inside the upper hole is not counted twice. And, as explained above, the volume of a particular hole is approximated by a cylinder, unless it is obvious that a different geometric shape ought to be used, given how the hole is formed. For example, a square or rectangular shape might better approximate a hole dug by an excavator bucket instead of an auger. In other instances, adding the liquid grout causes the liquid grout to be added to the deep hole and the upper hole if present in an amount, the amount being no more than about 70%, no more than about 80%, no more than about 90%, no more than about 100%, no more than about 110%, no more than about 120%, no more than about 130%, no more than about 140%, or no more than about 150% of the volume of the deep hole plus the volume of the upper hole if present.

In some instances, a pile hat is fastened to close the upper end of the pile. The pile hat is usually a small piece of metal that is bolted or welded to the upper end.

A pile or pile assembly can be tied to supported structure above in any suitable manner. For example, a layer of reinforced concrete can represent a pile cap encompassing the upper end and a portion of the reinforcing structure. The pile cap can have any suitable dimensions. One foot thick, to several feet thick, may be mentioned. Supported structure may include, but is not limited to, pile caps, grade beams, concrete masonry unit ("CMU") columns and structures, concrete column and structures other than pile caps, beams such as steel or timber, and traditional bracing, alone or in combinations. In some cases, the upper end is embedded in a concrete structure such as a pile cap a vertical distance of at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 1 foot, at least about 1.5 feet, at least about 2 feet, or at least about 3 feet. In other cases, the upper end of the pile is embedded in a concrete structure such as a pile cap no more than about 2 inches, no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 1 foot, and no more than about 1.5 feet, more than about 2 feet, or no more than about 3 feet. In still other cases, the upper end is embedded in a concrete structure such as a pile cap with a minimum distance from the edge of the concrete structure of at least about 2 inches, at least about 3 inches, at least about 4 inches, at least about 5 inches, or at least about 6 inches.

Independent of whether and how far the upper end of the pile is embedded in the pile cap, the reinforcing structure can have its uppermost feature embedded in the pile cap a vertical distance of at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 1 foot, at least about 1.5 feet, at least about 2 feet, or at least about 3 feet. In other cases, the uppermost feature of the reinforcing structure is embedded in a concrete structure such as a pile cap no more than about 2 inches, no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 1 foot, and no more than about 1.5 feet, more than about 2 feet, or no more than about 3 feet. In still other cases, the reinforcing structure is embedded in a concrete structure such as a pile cap with a minimum distance from the edge of the concrete structure of at least about 2 inches, at least about 3 inches, at least about 4 inches, at least about 5 inches, or at least about 6 inches.

Certain embodiments of the present invention also relate to pile assemblies. As used herein, a pile assembly includes a pile having a lower end opposite an upper end, the pile being in soil; a reinforcing structure proximal to the upper end; and hardened grout about the pile and the reinforcing structure. The hardened grout "about" the pile and the reinforcing structure may include hardened grout inside the pile, outside the pile, inside the reinforcing structure between the reinforcing structure and the pile, and/or outside the reinforcing structure, as desired. A pile assembly may include any suitable additional structure. For example, in some cases, the pile comprises a helical pile lead section comprising the lower end, and one or more additional sections added to the helical pile lead section connecting to and comprising the upper end.

As described above, the reinforcing structure of a pile assembly can include any suitable form. In some cases, a pile assembly includes a reinforcing structure that comprises a rebar cage, an outer pipe coaxial with the pile, or a combination thereof. Any suitable outer pipe may be used.

For example, in certain instances, the outer pipe has an outer pipe diameter that is at least about 3 inches, at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, at least about 20 inches, or at least about 30 inches. In other instances, the outer pipe has an outer pipe diameter that is no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, no more than about 20 inches, no more than about 30 inches, or no more than about 40 inches.

The pile appearing in a pile assembly of the present invention may include any suitable pile, such as, for example, any of the piles described herein. Sometimes, the pile has a pile diameter that is at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, or at least about 20 inches. At other times, a suitable pile has a pile diameter that is no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, or no more than about 20 inches. Certain instances provide a pile having a nominal diameter of 3.5 inches, 4.5 inches, or 5.5 inches. Optionally, the pile is protected from corrosion by being encased in grout, by partial or complete galvanization, or a combination thereof. For example, the upper end, the lower end, or both may be galvanized, or the entire pile may receive a galvanization treatment before installation. Similarly, the reinforcing structure may be partially or completely galvanized, in some examples. Suitable galvanization treatments include those known in the art.

As is known in the art, a pile or a pipe is often referred to by its diameter. The thickness of the pile or the pipe obviously renders an inner diameter and an outer diameter that differ. Unless specified, as used herein, "diameter" such as Diameter or Outer Pipe Diameter refers to the nominal pipe size in use in North America. Usually, because the Outer Pipe Diameter differs significantly from the Pile Diameter, one of ordinary skill in the art need not consider the thickness of the pile or the pipe. Any suitable thicknesses can be used. In some cases, the thickness of the material of a pile or an outer pipe is at least about 2 mm. In other cases, the thickness of the material of a pile or an outer pipe is no more than about 10 cm.

A pile may have any suitable length. For example, a pile comprising a helical pile lead section and optionally one or more additional sections can have a length from its lower end to its upper end of at least about 2 feet, at least about 5 feet, at least about 10 feet, at least about 15 feet, at least about 20 feet, at least about 25 feet, at least about 30 feet, at least about 40 feet, at least about 50 feet, at least about 75 feet, at least about 100 feet, at least about 125 feet, or at least about 150 feet. For another example a pile can have a length from its lower end to its upper end of no more than about 2 feet, no more than about 5 feet, no more than about 10 feet, no more than about 15 feet, no more than about 20 feet, no more than about 25 feet, no more than about 30 feet, no more than about 40 feet, no more than about 50 feet, no more than about 75 feet, no more than about 100 feet, no more than about 125 feet, or no more than about 150 feet.

Piles, reinforcing cages of rebar, outer pipes, liquid grout, and any other material useful in the present invention can be any suitable material made according to any suitable process. For example, those materials and processes known in the art can be used. In certain instances, a pile, rebar, or pipe is made from steel. Any suitable steel can be used. Stainless steels, carbon steels, and the like may be mentioned. The steel components can be welded together, molded as one, bolted together, or otherwise attached in any suitable manner. The piles can exhibit any suitable properties and performance. In some cases, the pile has a minimum tensile strength of about 50 ksi and a minimum yield strength of about 40 ksi.

Piles of the present invention can be manufactured in any suitable manner. In some cases, making a pile involves welding together the various sections to make up the pile. In other cases, pipes are drilled with bolt holes, and the pipes are bolted together to make the pile. The order of steps is not critical. Optionally, various holes, for additional bolts, for grout, or for either or for another purpose can be drilled before or after welding components together.

Any suitable liquid grout can be used. Very large rocks in the liquid grout are discouraged, as they could lodge in the holes and hinder the flow of liquid grout into the casing. Otherwise, concretes such as are known in the art using a suitable cement such as those known as Portland cement can be used as liquid grout, for example. Polymeric grouts may be used in some applications. It is desired that the liquid grout flows along the pile to form solid domains of grout supporting the pile. In some cases, the solid grout forms a solid case of concrete around the pile when installation is complete and the grout has fully cured. In other cases, pouring the liquid grout might not lead to a perfect encasement of the pile by the solidified grout.

As used herein, "soil" indicates any solid material found on Earth with the exception of monolithic rock. Soils may include mud, silt, sand, clay, pebbles, compacted forms of any of those, and combinations thereof. Placing the piles of the present invention in monolithic rock such as bedrock may require pre-formed channels in the rock formed by suitable methods such as those known in the art.

The structures that can be built on the soils stabilized with the piles described herein are not limited. Roads, sidewalks, runways, parking lots, bridge footings, docks, boardwalks, swimming pools, storage tanks, chemical processing equipment such as refineries, windmills, and oil drilling platforms including those deployed at sea, may be mentioned. Foundations for buildings, and the buildings themselves, such as homes, warehouses, factories, office buildings, and the like may be mentioned. Further, at least some of the piles of the present invention can be used to stabilize soil when the only purpose is to stabilize the soil. It may be beneficial to have the soil adjacent a structure be stabilized in the event of flooding or earthquake, and that can be accomplished with piles of the present invention.

DETAILED DESCRIPTION OF THE DRAWINGS

Further embodiments of the present invention can be described by reference to the accompanying drawings.

FIGS. 1-7 depict the construction of one embodiment of the present invention, pile assembly 101, according to a method of the present invention.

Figure 2:
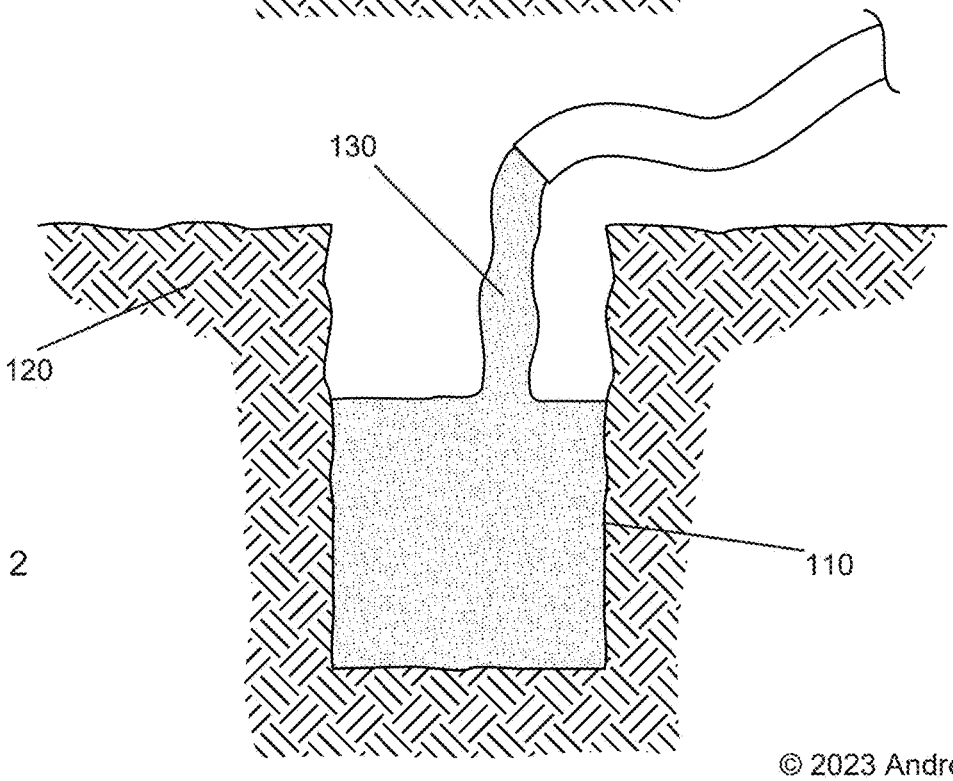
FIG. 2 depicts a cut-away side view of liquid grout 130 being added to upper hole 110.
Figure 3:
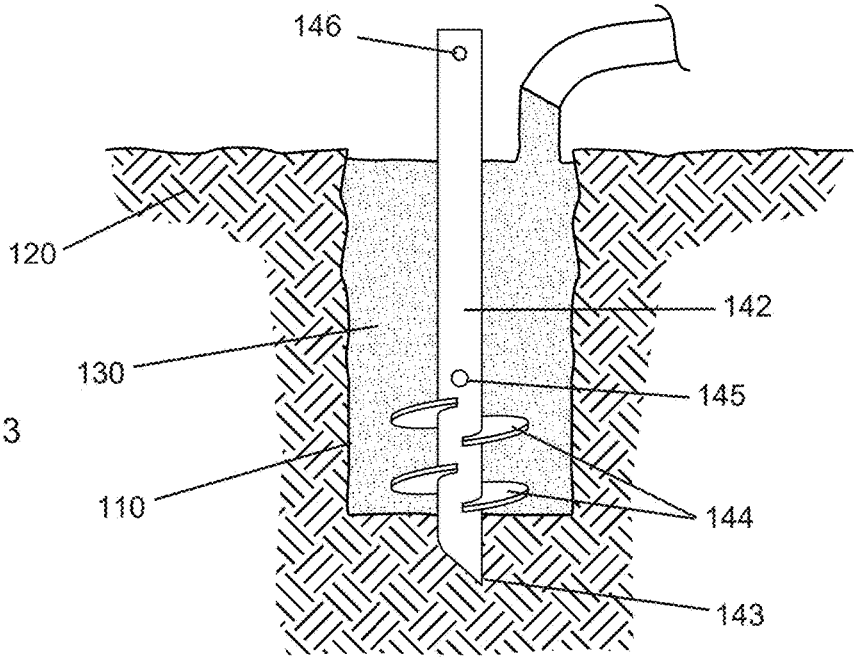
FIG. 3 depicts a cut-away side view of helical pile lead section 142 inserted into upper hole 110.
Figure 4:
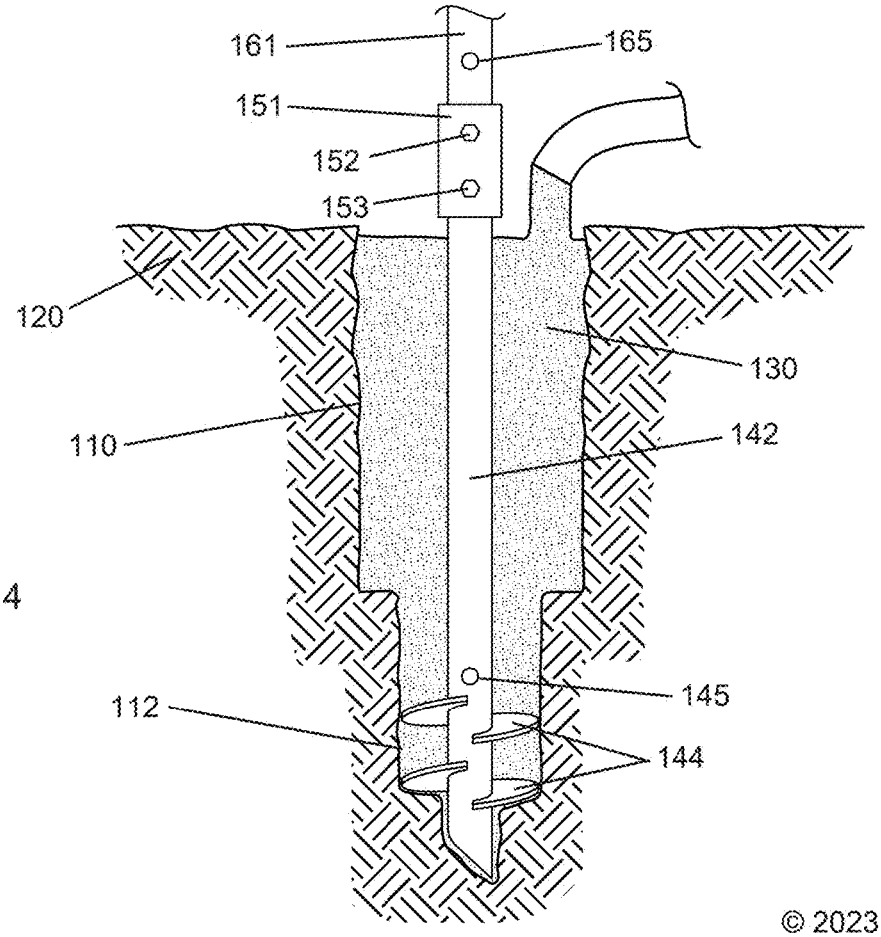
FIG. 4 depicts a cut-away side view of helical pile lead section 142 being driven into soil 120, creating deep hole 112.

FIG. 1 shows auger 111 pre-drilling upper hole 110 in soil 120, leaving dirt pile 121. In FIG. 2, liquid grout 130 is added to upper hole 110. FIG. 3 depicts a cut-away side view of helical pile lead section 142 inserted coaxially into upper hole 110. By rotating helical pile lead section 142, helical screws 144 engage soil 120, driving helical pile lead section 142 and creating deep hole 112 about helical pile lead section 142. See FIG. 4. Liquid grout 130 is continually added to upper hole 110, which thereby adds liquid grout to deep hole 112 as deep hole 112 is created. In FIG. 4, the driving of helical pile lead section 142 has paused for a moment so that additional section 161 can be added to helical pile lead section 142 during the driving of helical pile lead section 142 into soil 120. Bolt splice 151 attaches additional section 161 to helical pile lead section 142 with bolts 152, 153. Bolt hole 146 (see FIG. 3) on helical pile lead section 142 receives bolt 153 (see FIG. 4). Helical pile lead section 142 includes grout hole 145. Additional section 161 includes grout hole 165.

Figure 5:
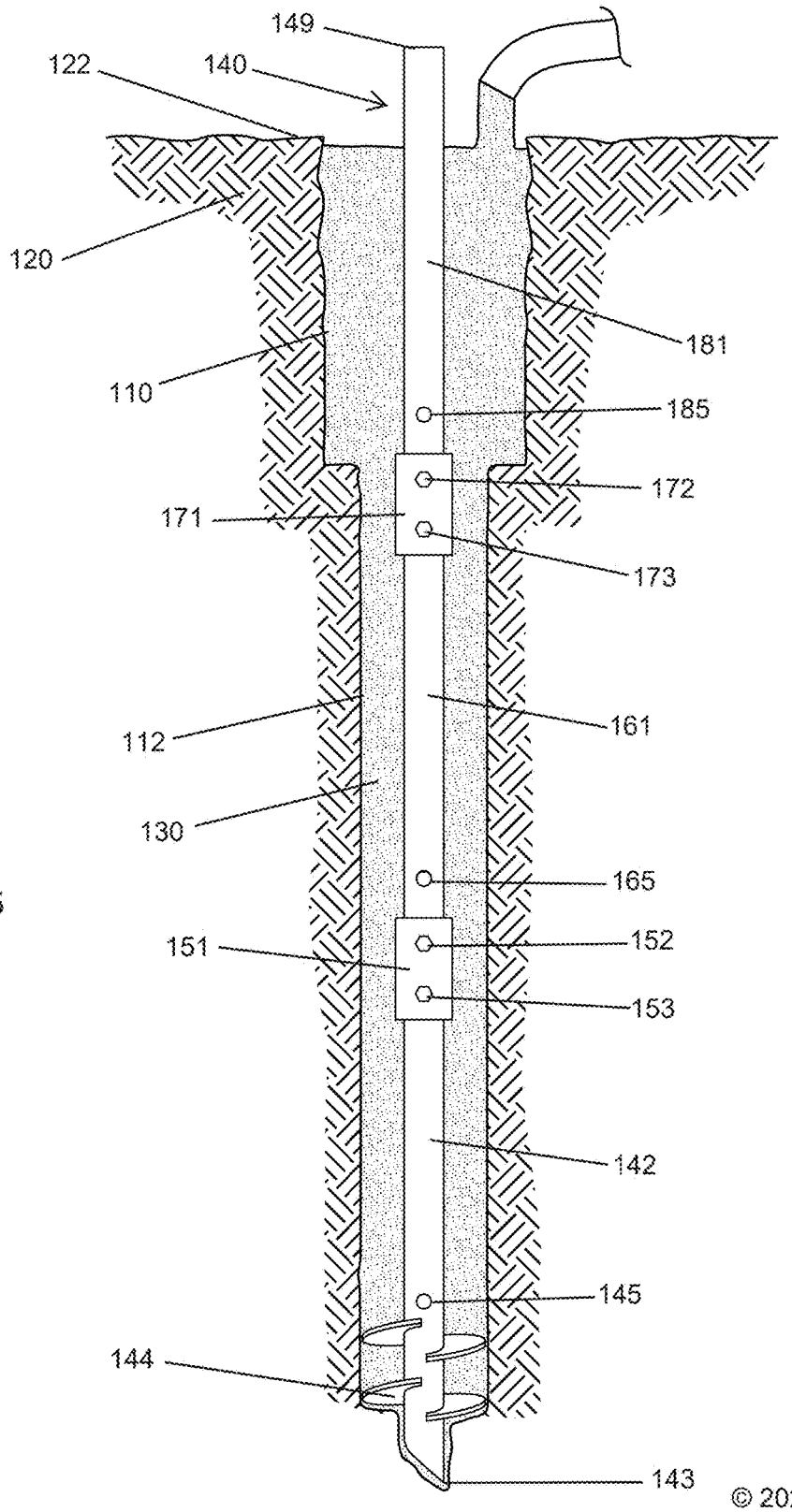
FIG. 5 depicts a cut-away side view of pile 140 being installed in soil 120.

Pile 140, shown complete in FIG. 5, includes helical pile lead section 142, additional section 161, and additional section 181. Lower end 143 appears at the lowest point of helical pile lead section 142, and upper end 149 appears at the top of additional section 181. Grout holes 145, 165, and 185 facilitate the flow of liquid grout 130 into pile 140. Pile 140 has been placed in upper hole 110 and deep hole 112 so that upper end 149 emerges a certain distance above surface 122 of soil 120. Additional section 181 is attached to additional section 161 via bolt splice 171, which uses bolts 172, 173 to hold the two sections 181, 161 together. As can be seen in FIG. 5, upper hole 110 is deep enough to allow a reinforcing structure 610 (see FIG. 6) to assist with the forces acting on the upper reaches of pile 140. Further, upper hole 110 has a wider diameter than deep hole 112.

Figure 6:
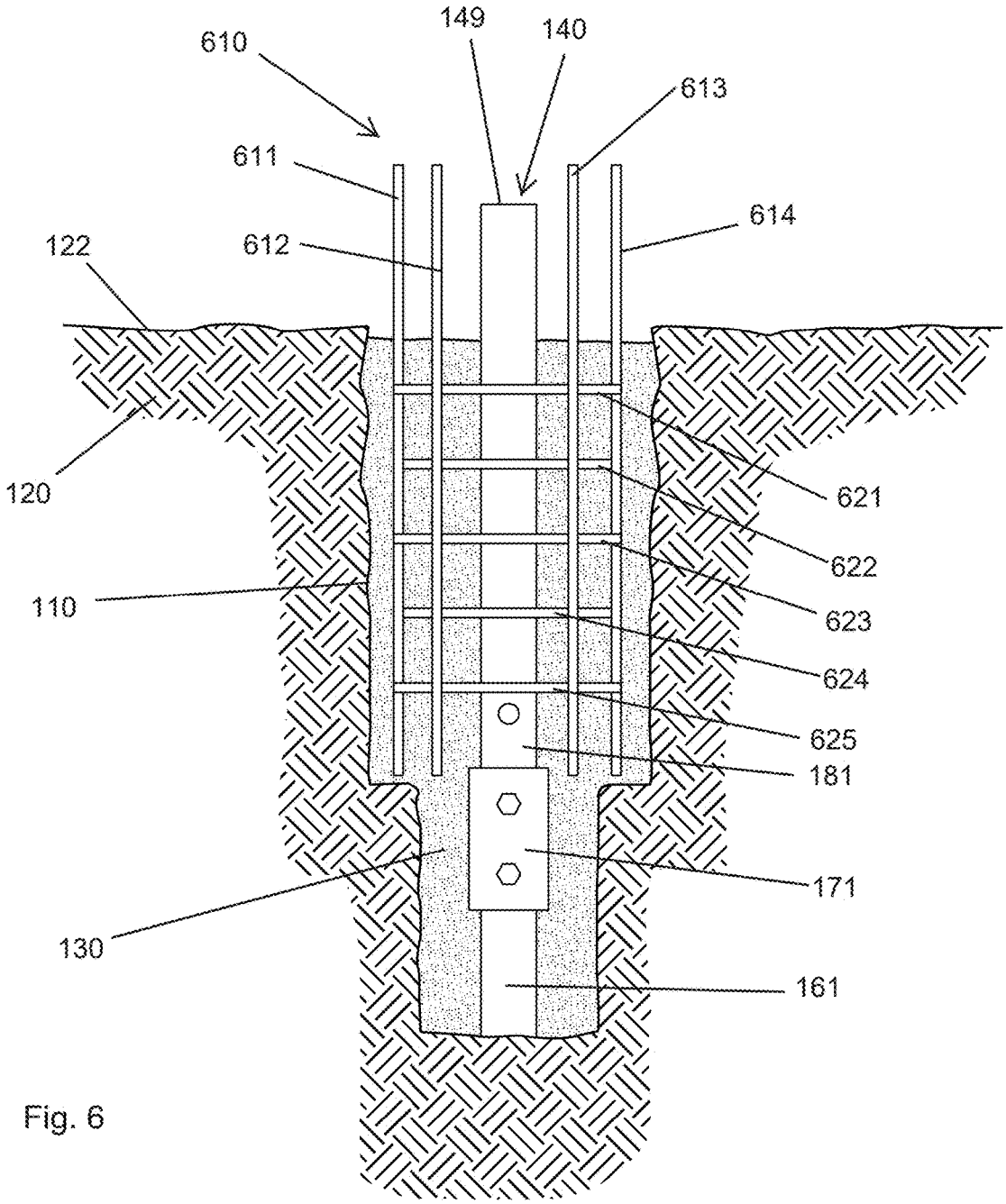
FIG. 6 depicts a partial cut-away side view of reinforcing structure 610 being added proximal to upper end 149 of pile 140 to create pile assembly 101.

FIG. 6 depicts a partial cut-away side view of reinforcing structure 610 being added proximal to upper end 149 of pile 140 (lower portion omitted from FIG. 6) to create pile assembly 101. Reinforcing structure 610 is a rebar cage comprising vertical rebar members 611, 612, 613 and 614, tied together with horizontal rebar rings 621, 622, 623, 624, and 625. Reinforcing structure 610 is placed into upper hole 110 before liquid grout 130 hardens. Vertical rebar members 611, 612, 613 and 614, along with upper end 149, emerge above surface 122 of soil 120 so that they may engage supported structure to be added. Pile assembly 101 (see FIG. 7) will include pile 140, reinforcing structure 610, and liquid grout 130 once it is allowed to harden.

Figure 7:
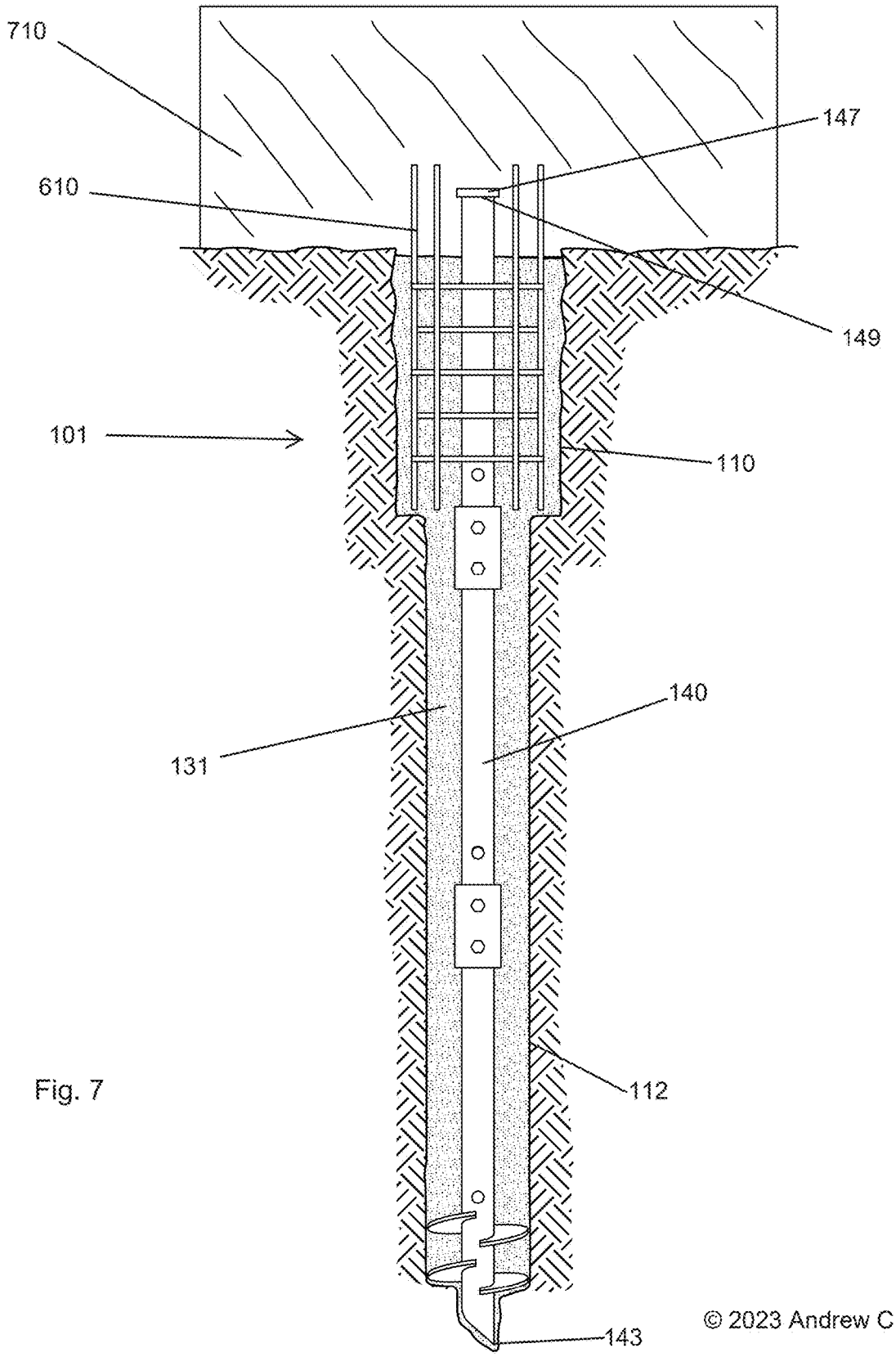
FIG. 7 depicts a cut-away side view of pile assembly 101 partially embedded in pile cap 710.

FIG. 7 depicts a cut-away side view of pile assembly 101 partially embedded in pile cap 710. Pile hat 147 has been added to upper end 149 of pile 140. Hardened grout 131 transfers lateral forces and maintains upper hole 110, deep hole 112, and the relative positions of pile 140, and reinforcing structure 610.

Figure 8:
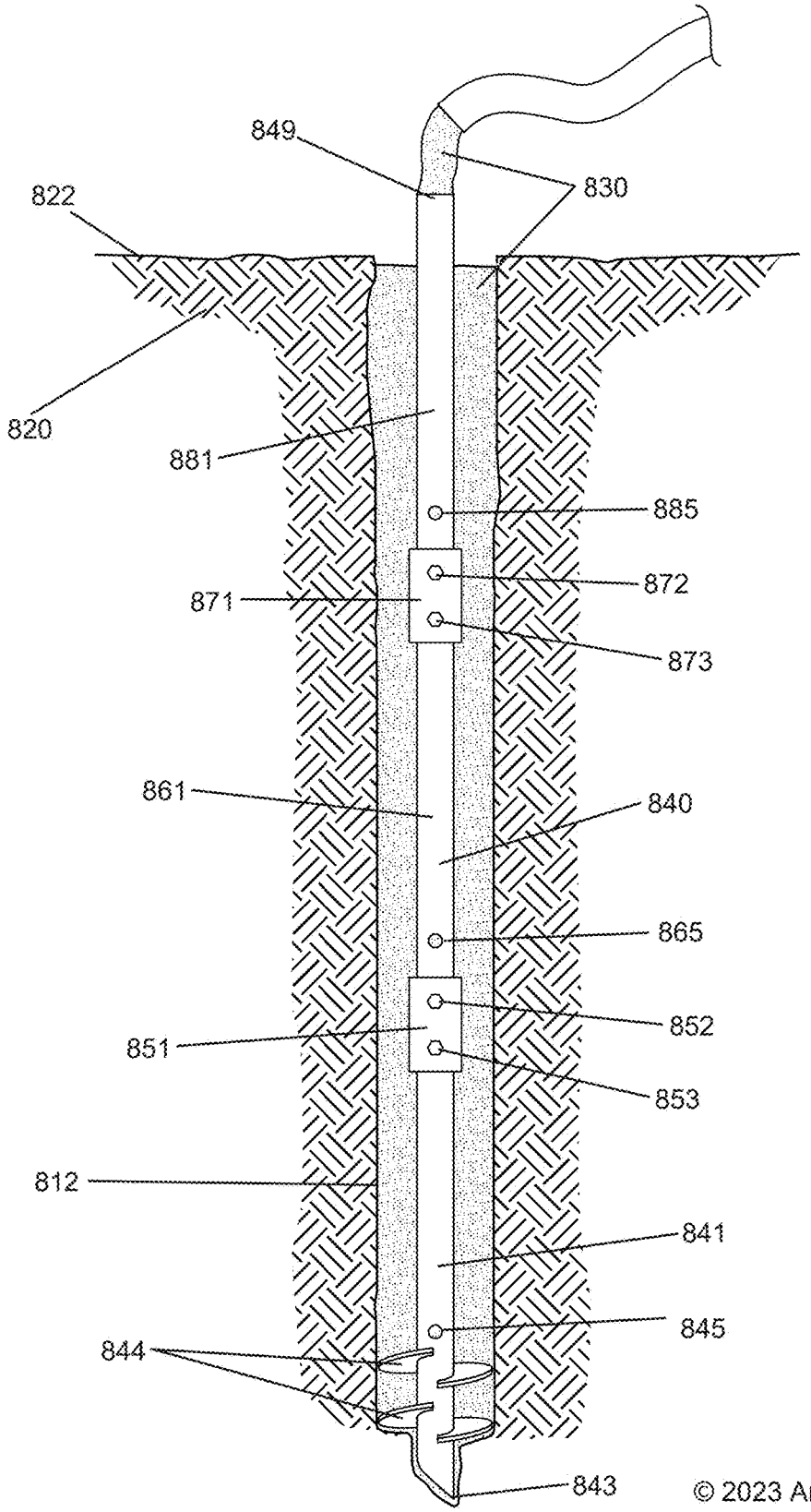
FIG. 8 depicts a cut-away side view of pile 840 creating deep hole 812 in soil 820.
Figure 9:
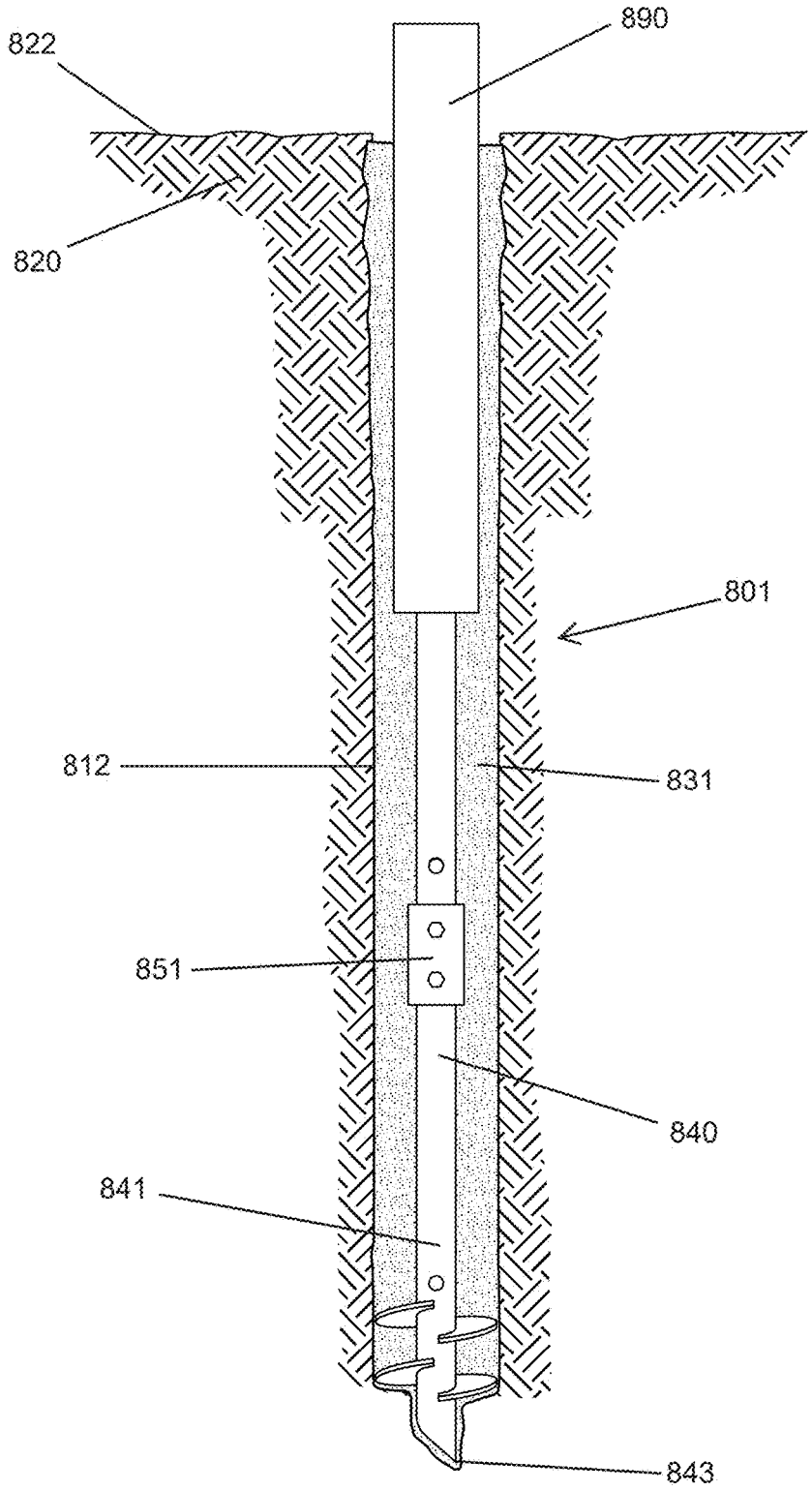
FIG. 9 depicts a cut-away side view of outer pipe 890 added as reinforcing structure proximal to upper end 849 of pile 840 to form pile assembly 801.
Figure 10:
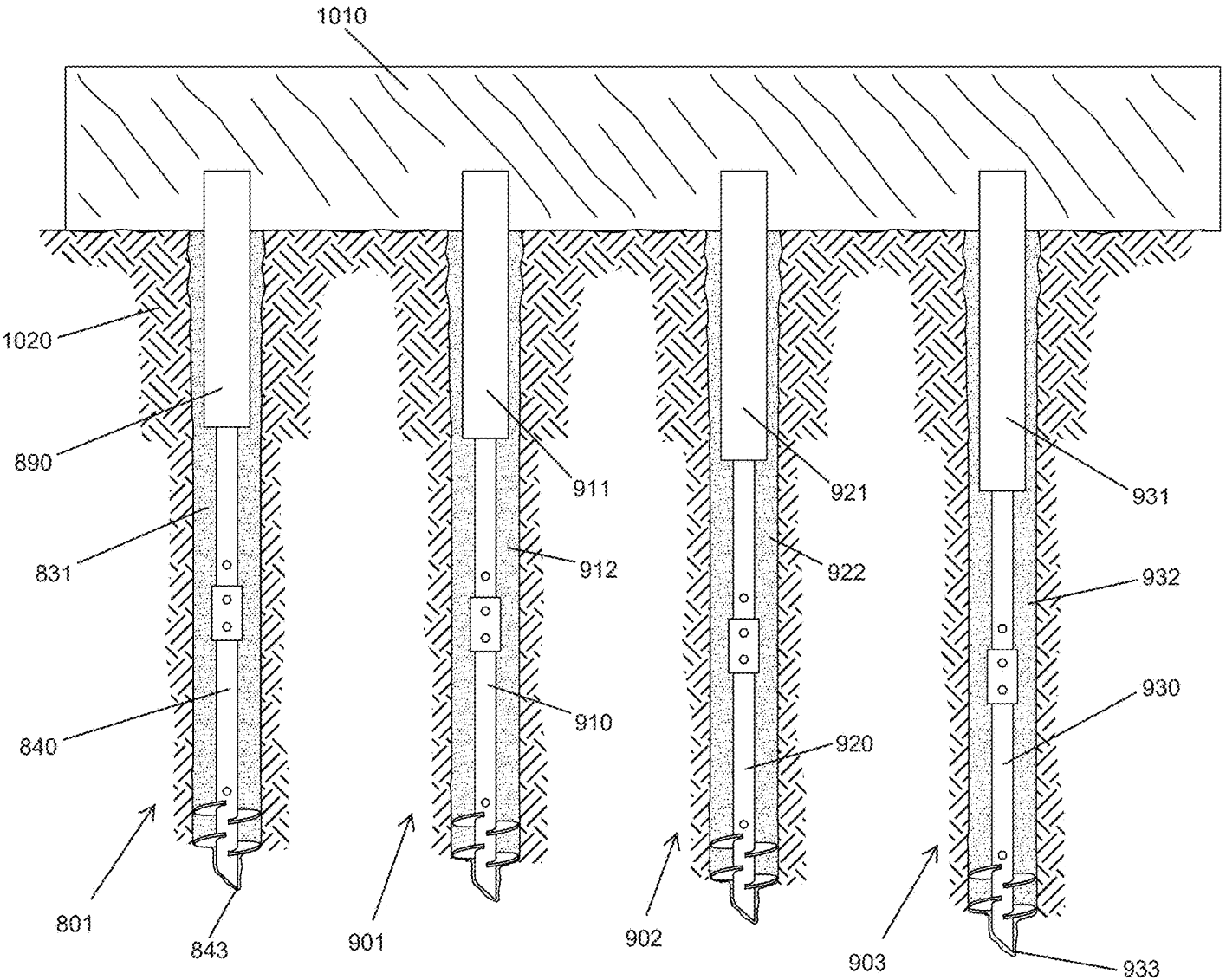
FIG. 10 depicts a cut-away side view of pile assemblies 801, 901, 902, and 903 partially embedded in pile cap 1010.

FIGS. 8-10 depict the construction and use of pile assembly 801. FIG. 8 depicts a cut-away side view of pile 840 creating deep hole 812 in soil 820 below surface 822. Deep hole 812 does not include an upper hole in this embodiment. Rotation of helical pile lead section 841 will cause helical screws 844 to drive helical pile lead section 841 into soil 820 creating deep hole 812. Liquid grout 830 is added through pile 840, which is hollow. Liquid grout 830 flows through grout holes 885, 865, and 845 into deep hole 812. Pile 840 includes helical pile lead section 841, additional section 861, and additional section 881, and has lower end 843 opposite upper end 849. Bolt splice 851 connects additional section 861 to helical pile lead section 841 using bolts 852, 853. Bolt splice 871 connects additional section 881 to additional section 861 using bolts 872, 873. Liquid grout 130 is added to deep hole 812 as it is created.

FIG. 9 depicts a cut-away side view of outer pipe 890 added as reinforcing structure proximal to upper end 849 of pile 840 to form pile assembly 801. Outer pipe 890 has a diameter wider than pile 840 and also of bolt splice 871. However, no upper hole has been pre-drilled in this case. Outer pipe 890 fits within deep hole 812. In some cases, care is taken so that at least 3 inches of grout separate the outer pipe 890 from the sides of deep hole 812. Pile assembly 801 includes pile 840, outer pipe 890 as reinforcing structure, and hardened grout 831. Pile 840 and outer pipe 890 have been positioned so that they emerge the same or different distances from surface 822 of soil 820.

FIG. 10 depicts a cut-away side view of pile assemblies 801, 901, 902, and 903, each partially embedded in pile cap 1010. Pile assembly 901 includes pile 910, outer pipe 911 as reinforcing structure, and hardened grout 912. Pile assembly 902 includes pile 920, outer pipe 921 as reinforcing structure, and hardened grout 922. Pile assembly 903 includes pile 930, outer pipe 931 as reinforcing structure, and hardened grout 932. As can be seen, pile 930 is longer than pile 840, and lower end 933 of pile 930 sits deeper in soil 1020 than lower end 843 of pile 840. Such a difference can be employed to accommodate different forces acting on different portions of the supported structure, pile cap 1010.

Figure 11:
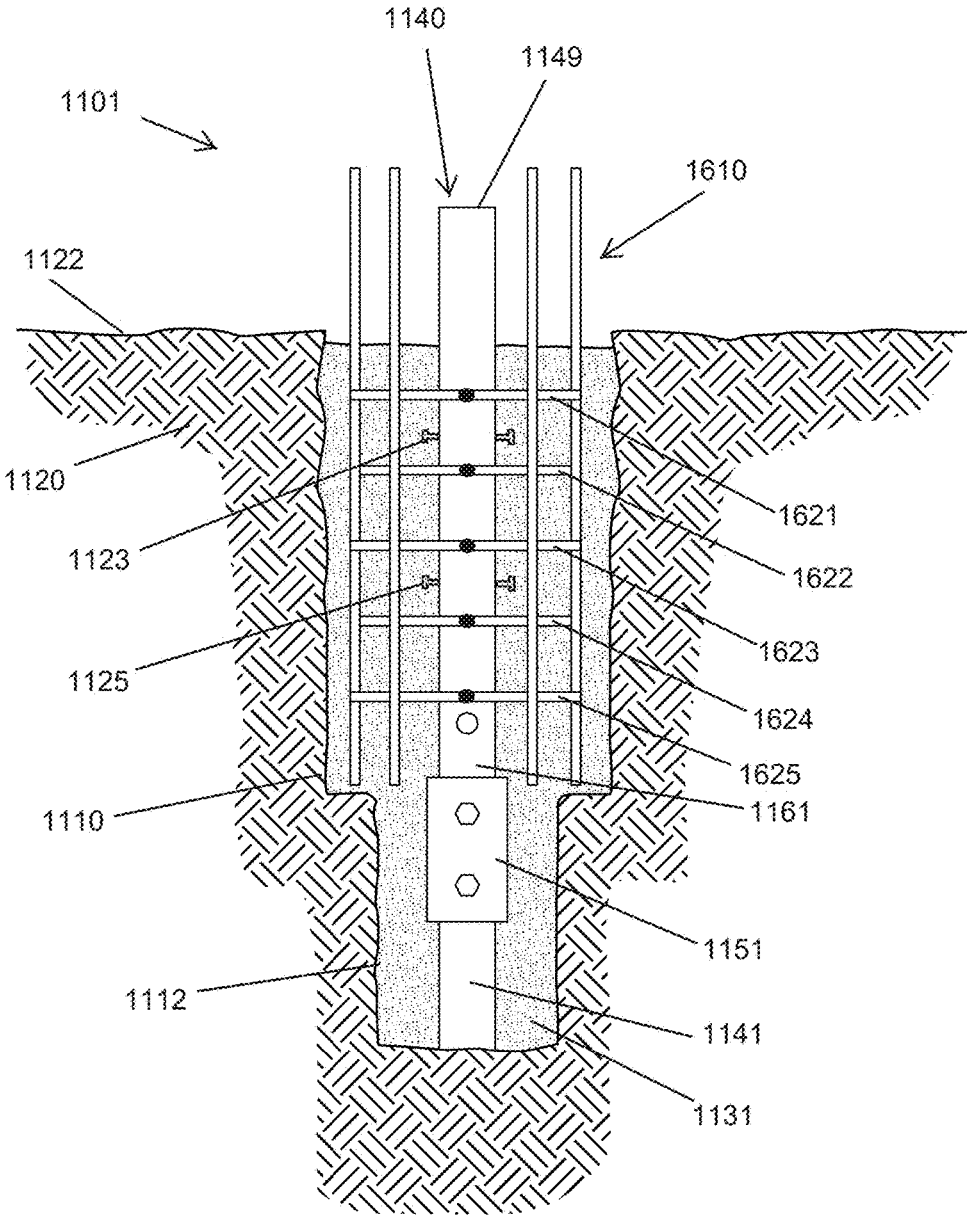
FIG. 11 depicts a cut-away partial side view of pile assembly 1101.

FIG. 11 depicts a cut-away partial side view of pile assembly 1101, which includes pile 1140, reinforcing structure 1610, and hardened grout 1131. Pile 1140 includes helical pile lead section 1141 (partially shown) connected to additional section 1161 by bolt splice 1151. Upper end 1149 is positioned a certain distance above surface 1122 of soil 1120. Hardened grout 1131 fills upper hole 1110 and lower hole 1112. Additional section 1161 includes Nelson studs 1123, 1125 that helps engage hardened grout 1131. Rebar members 1621, 1622, 1623, 1624, and 1625 are attached directly to additional section 1161, and emerge therefrom to form a rebar cage that is reinforcing structure 1610.

EXAMPLES

Example 1—Piles with No Reinforcing Structure

Proprietary piles of the Applicant installed with grout inside were calculated to have the following bending strengths given predicted axial loads:

| Nominal Diameter of Pile | Bending Strength with 0k Axial Load | Bending Strength with 200k Axial Load |
|---|---|---|
| 5.5" | | 460 k-in. |
| 3.5" | 150 k-in. | |

A grout column of 8 inches outer diameter around the pile may be assumed, but is not factored into the bending strength calculation. Only the pile and grout inside the pile are factored into that calculation.

Example 2—Piles with 20 Inch Upper Hole and Rebar Cage Reinforcing Structure Proprietary piles of the Applicant installed with grout with upper holes having a diameter of 20 inches and a depth of 4 feet to 7 feet, with an appropriately-dimensioned rebar cage comprising six No. 5 rebar vertical members tied with circular No. 4 rebar horizontal members spaced 4 inches apart, with the bottom of the rebar cage at least 3 inches from the bottom of the upper hole, were examined for calculated bending strength.

| Nominal Diameter of Pile | Bending Strength with 0k Axial Load | Bending Strength with 100k Axial Load | Bending Strength with 200k Axial Load |
|---|---|---|---|
| 5.5" | 1,500 k-in. | 1,700 k-in. | 1,850 k-in. |
| 4.5" | 1,300 k-in. | 1,500 k-in. | 1,650 k-in. |
| 3.5" | 1,200 k-in. | 1,400 k-in. | |

Example 3—Piles with 18 Inch Upper Hole and Rebar Cage Reinforcing Structure

Proprietary piles of the Applicant installed with grout with upper holes having a diameter of 18 inches and a depth of 4 feet to 7 feet, with an appropriately-dimensioned rebar cage comprising six No. 5 rebar vertical members tied with circular No. 4 rebar horizontal members spaced 4 inches apart, with the bottom of the rebar cage at least 3 inches from the bottom of the upper hole, were examined for calculated bending strength.

| Nominal Diameter of Pile | Bending Strength with 0k Axial Load | Bending Strength with 100k Axial Load | Bending Strength with 200k Axial Load |
|---|---|---|---|
| 5.5" | 1,300 k-in. | 1,400 k-in. | 1,450 k-in. |
| 4.5" | 1,000 k-in. | 1,200 k-in. | 1,300 k-in. |
| 3.5" | 960 k-in. | 1,080 k-in. | |

Example 4—Piles with 16 Inch Upper Hole and Rebar Cage Reinforcing Structure

Proprietary piles of the Applicant installed with grout with upper holes having a diameter of 16 inches and a depth of 4 feet to 7 feet, with an appropriately-dimensioned rebar cage comprising six No. 5 rebar vertical members tied with circular No. 4 rebar horizontal members spaced 4 inches apart, with the bottom of the rebar cage at least 3 inches from the bottom of the upper hole, were examined for calculated bending strength.

| Nominal Diameter of Pile | Bending Strength with 0k Axial Load | Bending Strength with 100k Axial Load | Bending Strength with 200k Axial Load |
|---|---|---|---|
| 5.5" | 1,000 k-in. | 1,075 k-in. | 1,080 k-in. |
| 4.5" | 825 k-in. | 835 k-in. | 830 k-in. |

Example 5—Piles with 14 Inch Upper Hole and Rebar Cage Reinforcing Structure

Proprietary piles of the Applicant installed with grout with upper holes having a diameter of 14 inches and a depth of 4 feet to 7 feet, with an appropriately-dimensioned rebar cage comprising six No. 5 rebar vertical members tied with circular No. 4 rebar horizontal members spaced 4 inches apart, with the bottom of the rebar cage at least 3 inches from the bottom of the upper hole, were examined for calculated bending strength.

| Nominal Diameter of Pile | Bending Strength with 0k Axial Load | Bending Strength with 100k Axial Load | Bending Strength with 200k Axial Load |
|---|---|---|---|
| 5.5" | 800 k-in. | 825 k-in. | 800 k-in. |
| 4.5" | 600 k-in. | 640 k-in. | 630 k-in. |

Results

By adding an upper hole, a rebar cage as reinforcing structure, and grout supporting the rebar cage, the calculated bending strength of a 5.5" pile under a 200 k axial load increased from 460 k-in. to 1,850 k-in., a four-fold increase. Similarly, the calculated bending strength of a 3.5" pile under a 0 k axial load increased from 150 k-in. to 1,200 k-in., an eight-fold increase. Thus, it is expected that the pile assemblies of the present invention will have three- to ten-times greater bending strength than the piles alone.

CLAUSES

The invention may be further understood by the clauses set forth below.

Clause 1. A method of installing a pile in soil, comprising: Optionally pre-drilling an upper hole in the soil and adding liquid grout thereto; Driving a helical pile lead section into the soil, coaxially with the upper hole if present, thereby creating a deep hole about the helical pile lead section; Adding liquid grout to the deep hole as it is created; Optionally adding one or more additional sections to the helical pile lead section before and/or during the driving of the helical pile lead section into the soil; Wherein the pile comprises the helical pile lead section and the one or more additional sections if present; Wherein the pile has a lower end defined by a deepest part of the helical pile lead section, and an upper end opposite the lower end; Adding a reinforcing structure proximal to the upper end of the pile; and Allowing the liquid grout to harden about the pile and the reinforcing structure.

Clause 2. The method of clause 1, wherein the upper hole has an upper hole diameter of at least about 6 inches, at least about 8 inches, at least about 10 inches, at least about 12 inches, at least about 14 inches, at least about 16 inches, at least about 20 inches, at least about 22 inches, at least about 24 inches, at least about 30 inches, at least about 36 inches, or at least about 48 inches.

Clause 3. The method of clause 1, wherein the upper hole has an upper hole diameter that is no more than about 6 inches, no more than about 8 inches, no more than about 10 inches, no more than about 12 inches, no more than about 14 inches, no more than about 16 inches, no more than about 20 inches, no more than about 22 inches, no more than about 24 inches, no more than about 30 inches, no more than about 36 inches, or no more than about 48 inches.

Clause 4. The method of any one of the preceding clauses, wherein the upper hole has an upper hole depth measured from the surface of the soil of at least about 2 feet deep, at least about 3 feet deep, at least about 4 feet deep, at least about 5 feet deep, at least about 6 feet deep, at least about 7 feet deep, at least about 8 feet deep, at least about 9 feet deep, at least about 10 feet deep, at least about 11 feet deep, at least about 12 feet deep, at least about 13 feet deep, at least about 14 feet deep, at least about 15 feet deep, at least about 16 feet deep, at least about 17 feet deep, at least about 18 feet deep, at least about 19 feet deep, at least about 20 feet deep, at least about 25 feet deep, or at least about 30 feet deep.

Clause 5. The method of any one of the preceding clauses, wherein the upper hole has an upper hole depth measured from the surface of the soil of no mor than about 2 feet deep, no more than about 3 feet deep, no more than about 4 feet deep, no more than about 5 feet deep, no more than about 6 feet deep, no more than about 7 feet deep, no more than about 8 feet deep, no more than about 9 feet deep, no more than about 10 feet deep, no more than about 11 feet deep, no more than about 12 feet deep, no more than about 13 feet deep, no more than about 14 feet deep, no more than about 15 feet deep, no more than about 16 feet deep, no more than about 17 feet deep, no more than about 18 feet deep, no more than about 19 feet deep, no more than about 20 feet deep, no more than about 25 feet deep, or no more than about 30 feet deep.

Clause 6. The method of any one of the preceding clauses, wherein the deep hole measured from the surface of the soil is at least about 5 feet deep, at least about 10 feet deep, at least about 15 feet deep, at least about 20 feet deep, at least about 25 feet deep, at least about 30 feet deep, at least about 40 feet deep, at least about 50 feet deep, at least about 75 feet deep, at least about 100 feet deep, at least about 125 feet deep, or at least about 150 feet deep.

Clause 7. The method of any one of the preceding clauses, wherein the deep hole measured from the surface of the soil is no more than about 5 feet deep, no more than about 10 feet deep, no more than about 15 feet deep, no more than about 20 feet deep, no more than about 25 feet deep, no more than about 30 feet deep, no more than about 40 feet deep, no more than about 50 feet deep, no more than about 75 feet deep, no more than about 100 feet deep, no more than about 125 feet deep, or no more than about 150 feet deep.

Clause 8. The method of any one of the preceding clauses, wherein the one or more additional sections are added with at least one bolted splice.

Clause 9. The method of any one of the preceding clauses wherein the helical pile lead section is driven into the soil so that the upper end achieves a final position relative to the surface of the soil.

Clause 10. The method of clause 9, wherein the final position is below the surface of the soil.

Clause 11. The method of clause 9, wherein the final position is above the surface of the soil.

Clause 12. The method of clause 11, wherein the final position is at least about 2 inches, at least about 4 inches, at least about 6 inches, at least about 8 inches, at least about 10 inches, at least about 12 inches, at least about 14 inches, at least about 18 inches, at least about 24 inches, at least about 36 inches, or at least about 48 inches, above the surface of the soil.

Clause 13. The method of clause 11, wherein the final position is no more than about 2 inches, no more than about 4 inches, no more than about 6 inches, no more than about 8 inches, no more than about 10 inches, no more than about 12 inches, no more than about 14 inches, no more than about 18 inches, no more than about 24 inches, no more than about 36 inches, or no more than about 48 inches, above the surface of the soil.

Clause 14. The method of any one of the preceding clauses, wherein the adding the reinforcing structure comprises affixing the reinforcing structure proximal to the upper end.

Clause 15. The method of clause 14, wherein the affixing comprises bolting, welding, or a combination thereof.

Clause 16. The method of any one of the preceding clauses, wherein the reinforcing structure comprises a rebar cage.

Clause 17. The method of any one of the preceding clauses, wherein the reinforcing structure comprises an outer pipe.

Clause 18. The method of any one of the preceding clauses, wherein the adding the liquid grout causes the liquid grout to be added to the deep hole and the upper hole if present in an amount, the amount being at least about 70%, at least about 80%, at least about 90%, at least about 100%, at least about 110%, at least about 120%, at least about 130%, at least about 140%, or at least about 150% of the volume of the deep hole plus the volume of the upper hole if present.

Clause 19. The method of any one of the preceding clauses, wherein the adding the liquid grout causes the liquid grout to be added to the deep hole and the upper hole if present in an amount, the amount being no more than about 70%, no more than about 80%, no more than about 90%, no more than about 100%, no more than about 110%, no more than about 120%, no more than about 130%, no more than about 140%, or no more than about 150% of the volume of the deep hole plus the volume of the upper hole if present.

Clause 20. The method of any one of the preceding clauses, comprising fastening a pile hat to close the upper end of the pile.

Clause 21. The method of any one of the preceding clauses, further comprising constructing a pile cap encompassing the upper end and a portion of the reinforcing structure.

Clause 22. The method of any one of the preceding clauses, wherein the pile is at least partially hollow, and adding liquid grout to the deep hole comprises passing liquid grout through the pile.

Clause 23. The method of clause 22, wherein the passing liquid grout employs gravity, pressure, or a combination thereof.

Clause 24. A pile, installed according to a method set forth in any one of the preceding clauses.

Clause 25. A pile assembly, comprising: A pile having a lower end opposite an upper end, the pile being in soil; A reinforcing structure proximal to the upper end; and Hardened grout about the pile and the reinforcing structure.

Clause 26. The pile assembly of clause 25, wherein the plie comprises a helical pile lead section comprising the lower end, and one or more additional sections added to the helical pile lead section connecting to and comprising the upper end.

Clause 27. The pile assembly of any one of clauses 25-26, wherein the reinforcing structure comprises a rebar cage.

Clause 28. The pile assembly of any one of clauses 25-27, wherein the reinforcing structure comprises an outer pipe.

Clause 29. The pile assembly of clause 28, wherein the outer pipe has an outer pipe diameter that is at least about 3 inches, at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, at least about 20 inches, or at least about 30 inches.

Clause 30. The pile assembly of any one of clauses 28-29, wherein the outer pipe has an outer pipe diameter that is no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, no more than about 20 inches, no more than about 30 inches, or no more than about 40 inches.

Clause 31. The pile assembly of any one of clauses 25-30, wherein the pile has a pile diameter that is at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, or at least about 20 inches.

Clause 32. The pile assembly of any one of clauses 25-31, wherein the pile has a pile diameter that is no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, or no more than about 20 inches.

Clause 33. The pile assembly of any one of clauses 25-32, further comprising a pile cap wherein the upper end of the pile is embedded in the pile cap.

Clause 34. The pile assembly of clause 33, wherein the upper end of the pile is embedded in the pile cap at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 1 foot, at least about 1.5 feet, at least about 2 feet, or at least about 3 feet.

Clause 35. The pile assembly of any one of clauses 32-33, wherein the upper end of the pile is embedded in the pile cap no more than about 2 inches, no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 1 foot, and no more than about 1.5 feet, more than about 2 feet, or no more than about 3 feet.

Clause 36. The pile assembly of any one of clauses 35-35, wherein the pile comprises one or more Nelson studs.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A method of installing a pile in soil having a surface, the method comprising:

pre-drilling an upper hole in the soil and adding liquid grout thereto;

driving a helical pile lead section into the soil, coaxially with the upper hole, thereby creating a lower hole about the helical pile lead section;

adding liquid grout to the lower hole as it is created;

optionally adding one or more additional sections to the helical pile lead section before and/or during the driving of the helical pile lead section into the soil;

wherein the pile comprises the helical pile lead section and the one or more additional sections if present;

wherein the pile has a lower end defined by a deepest part of the helical pile lead section, and an upper end opposite the lower end;

wherein the helical pile lead section is driven into the soil so that the upper end achieves a final position at least about 3 inches above the surface of the soil;

with the upper end at the final position, affixing a reinforcing structure to the pile proximal to the upper end, wherein the affixing comprises bolting, welding, or a combination thereof; and allowing the liquid grout to harden about the pile and the reinforcing structure.

2. The method of claim 1, wherein the upper hole has an upper hole diameter of at least about 14 inches.

3. The method of claim 1, wherein the upper hole has an upper hole diameter no more than about 20 inches.

4. The method of claim 1, wherein the upper hole has an upper hole depth measured from the surface of the soil of at least about 4 feet.

5. The method of claim 1, wherein the upper hole has an upper hole depth measured from the surface of the soil of no more than about 15 feet.

6. The method of claim 1, wherein the pile has a length from the upper end to the lower end of at least about 20 feet.

7. The method of claim 1, wherein the pile has a length from the upper end to the lower end of no more than about 100 feet.

8. The method of claim 1, wherein the one or more additional sections are added with at least one bolted splice.

9. The method of claim 1, wherein the reinforcing structure comprises a rebar cage.

10. The method of claim 1, wherein the reinforcing structure comprises an outer pipe.

11. The method of claim 1, wherein the adding the liquid grout causes the liquid grout to be added to the lower hole and the upper hole in an amount, the amount being at least about 90% of the volume of the lower hole plus the volume of the upper hole-if-present.

12. The method of claim 1, further comprising constructing a pile cap encompassing the upper end and a portion of the reinforcing structure.

13. The method of claim 1, wherein the pile is at least partially hollow, and the adding liquid grout to the lower hole comprises passing liquid grout through the pile.

14. The method of claim 13, wherein the passing liquid grout employs gravity, pressure, or a combination thereof.

15. The method of claim 1, wherein the pile comprises one or more Nelson studs.

16. The method of claim 1, wherein the reinforcing structure extends above the soil.

* * * * *